US006892768B1

(12) United States Patent
Ours et al.

(10) Patent No.: US 6,892,768 B1
(45) Date of Patent: May 17, 2005

(54) STRETCH WRAP TRANSPORTABLE CONTAINER AND METHOD

(75) Inventors: David C. Ours, Marshall, MI (US); Randall L. Cary, Battle Creek, MI (US)

(73) Assignee: Kellogg Company, Battle Creek, MI (US)

( * ) Notice: Subject to any disclaimer, the term of this patent is extended or adjusted under 35 U.S.C. 154(b) by 175 days.

(21) Appl. No.: 10/732,133

(22) Filed: Dec. 10, 2003

(51) Int. Cl.[7] ..... B65B 1/04

(52) U.S. Cl. ..... 141/10; 141/114; 141/313; 141/578; 141/573

(58) Field of Search ..... 141/10, 114, 313–317, 141/95, 198; 53/573–579

(56) References Cited

U.S. PATENT DOCUMENTS

| | | | | | |
|---|---|---|---|---|---|
| 2,765,816 | A | | 10/1956 | Carter | |
| 3,374,599 | A | | 3/1968 | Sanders | |
| 3,570,749 | A | | 3/1971 | Sato et al. | |
| 3,778,962 | A | | 12/1973 | James | |
| 3,785,410 | A | | 1/1974 | Carter | |
| 3,906,591 | A | | 9/1975 | Boiardi | |
| 3,928,940 | A | | 12/1975 | Fagniart | |
| 3,943,988 | A | | 3/1976 | Consorti | |
| 3,949,536 | A | * | 4/1976 | Chevalier | 53/570 |
| 3,968,626 | A | | 7/1976 | Hobbs | |
| 4,074,507 | A | | 2/1978 | Ruf et al. | |
| 4,101,292 | A | | 7/1978 | Hogan, II | |
| 4,113,146 | A | | 9/1978 | Williamson | |
| 4,136,501 | A | | 1/1979 | Connolly | |
| 4,219,054 | A | | 8/1980 | Carter et al. | |
| 4,223,061 | A | | 9/1980 | Michaels | |
| 4,249,839 | A | | 2/1981 | Vance | |
| 4,253,507 | A | | 3/1981 | Williamson | |
| 4,299,076 | A | | 11/1981 | Humphrey | |
| 4,339,040 | A | | 7/1982 | Peil et al. | |
| 4,360,996 | A | | 11/1982 | Rutter | |
| 4,500,001 | A | | 2/1985 | Daniels | |
| 4,546,593 | A | | 10/1985 | Lasscock | |
| 4,648,432 | A | | 3/1987 | Mechalas | |
| 4,706,441 | A | | 11/1987 | Chervalier | |
| 4,734,292 | A | | 3/1988 | Gerardus Van Boxtel | |
| 4,753,060 | A | | 6/1988 | Furukawa | |
| 4,781,475 | A | | 11/1988 | LaFleur | |
| 5,025,925 | A | | 6/1991 | Wiklund | |
| 5,353,936 | A | | 10/1994 | Dockstader et al. | |
| 5,354,569 | A | | 10/1994 | Brown et al. | |
| 5,501,254 | A | * | 3/1996 | Bjorklund | 141/65 |
| 5,507,859 | A | | 4/1996 | Kaiser | |
| 5,544,472 | A | | 8/1996 | Koskinen et al. | |
| 5,566,530 | A | | 10/1996 | Johnstone et al. | |
| 5,567,048 | A | | 10/1996 | Hammonds | |
| 5,573,044 | A | | 11/1996 | Mechalas | |
| 5,598,684 | A | | 2/1997 | Aarts | |
| 5,678,387 | A | | 10/1997 | Aarts | |
| 5,687,551 | A | * | 11/1997 | Mustain et al. | 53/468 |
| 5,787,945 | A | | 8/1998 | Riemersma | |
| 5,809,744 | A | | 9/1998 | Villines et al. | |
| 5,887,409 | A | | 3/1999 | Leal Pereira DaSilva | |
| 5,967,579 | A | | 10/1999 | Hebert | |
| 6,012,266 | A | | 1/2000 | Koskinen et al. | |
| 6,131,766 | A | | 10/2000 | King et al. | |
| 6,138,723 | A | * | 10/2000 | Wagner | 141/313 |
| 6,205,750 | B1 | | 3/2001 | Koskinen et al. | |
| 6,324,818 | B1 | | 12/2001 | Morness et al. | |
| 6,343,459 | B1 | | 2/2002 | Seaward et al. | |
| 6,494,324 | B2 | | 12/2002 | Ours et al. | |
| 2001/0008567 | A1 | | 7/2001 | Burkhardt | |
| 2002/0191869 | A1 | | 12/2002 | Stewart et al. | |

* cited by examiner

*Primary Examiner*—Steven O. Douglas
(74) *Attorney, Agent, or Firm*—Howard & Howard

(57) ABSTRACT

The invention provides a diameter reducing system for reducing the diameter of a flexible container as the container is filled. The system includes a stretching devise to stretch the container at the fill level as the container is filled with a plurality of particles. The stretching device can release a stretched portion of the container substantially at the fill level as the fill level rises. The container can be a flexible, elastic bag. Shrinking of the container at the fill level as the container fills promotes supporting engagement between particles to enhance the structural integrity of the filled container and to reduce the likelihood that particles will be damaged during movement of the filled container.

17 Claims, 4 Drawing Sheets

STRETCH WRAP TRANSPORTABLE CONTAINER AND METHOD

BACKGROUND OF THE INVENTION

1. Field of the Invention

The invention relates to a container configured to hold a plurality of articles, and, more particularly, to a radially flexible container with means to hold the contents so that a blow or acceleration will not damage the contents.

2. Description of the Related Art

Articles can be contained and transported in flexible containers such as bags. It can be desirable to limit the movement of individual articles in the flexible container with respect to one another to reduce the likelihood that articles will be damaged and to increase the likelihood that the container will maintain a relatively rigid shape. Several different methods have been proposed to limit the movement of individual articles in the flexible container with respect to one another. For example, it is known to fill a flexible container and shrink-wrap the filled container. It is known to draw air from the flexible container to define a vacuum, wherein the vacuum seal can substantially limit the movement of articles in the container with respect to one another. It also is known to compress a filled, flexible container with pressurized air to urge air from the flexible container and substantially limit movement of articles in the container with respect to one another.

The present inventors previously made invention of a Transportable Container for Bulk Goods and Method for Forming the Container, U.S. Pat. No. 6,494,324. A radially flexible container is filled with a filling system and the diameter of the container is reduced at the fill level as the fill level rises.

SUMMARY OF THE INVENTION AND ADVANTAGES

The subject invention provides an improvement over the prior diameter reducing system wherein the diameter of the container at the fill level is reduced by first stretching the container for filling and releasing a portion of the stretched container substantially at the fill level. A fixture including a plurality of arms can receive the container in a substantially un-stretched or relaxed configuration and stretch the container for filling. A large diameter of the stretched container receives particles and is released from the stretched configuration substantially at the fill level to a smaller fill diameter. The release of the stretched portion of the container generates hoop forces and promotes controllable contact between particles.

Accordingly, the subject invention provides an alternative to stretch wrap to reduce the diameter of the container. The amount of material required to package particles is reduced by the elimination of stretch wrap. The amount of waste material from used packaging material is reduced by the elimination of stretch wrap.

Other applications of the present invention will become apparent to those skilled in the art when the following description of the best mode contemplated for practicing the invention is read in conjunction with the accompanying drawings.

DETAILED DESCRIPTION OF A PREFERRED EMBODIMENT

Throughout the present specification and claims the phrase fill material is used as a shorthand version of the wide range of products that can be packaged utilizing the present invention. The terms fill material, articles, and particles can be used interchangeably. The present invention finds utilization in packaging any material that is packaged. These items can encompass large bulk packaged pieces as well as very small bulk packaged pieces. Examples of smaller fill materials include, but are not limited to, the following: agricultural products like seeds, rice, grains, vegetables, fruits; chemical products like fine chemicals, pharmaceuticals, raw chemicals, fertilizers; plastics like plastic resin pellets, plastic parts, rejected plastic parts, machined plastic parts; cereals and cereal products such as wheat; a variety of machined parts of all sorts; wood products like wood chips, landscaping material, peat moss, dirt, sand, gravel, rocks and cement. The present invention also finds utilization in bulk packaging of larger fill material including, but not limited to: prepared foods; partially processed foods like frozen fish, frozen chicken, other frozen meats and meat products; manufactured items like textiles, clothing, footwear; toys like plastic toys, plastic half parts, metallic parts, soft toys, stuffed animals, and other toys and toy products. All of these types of materials and similar bulk packaged materials are intended to be encompassed in the present specification and claims by this phrase.

The present invention can be applied in combination with any of the features disclosed in U.S. Pat. No. 6,494,324, which is hereby incorporated by reference in its entirety. Some of the features disclosed in U.S. Pat. No. 6,494,324 that can be applied in combination with present invention are described briefly below.

Figure 1:
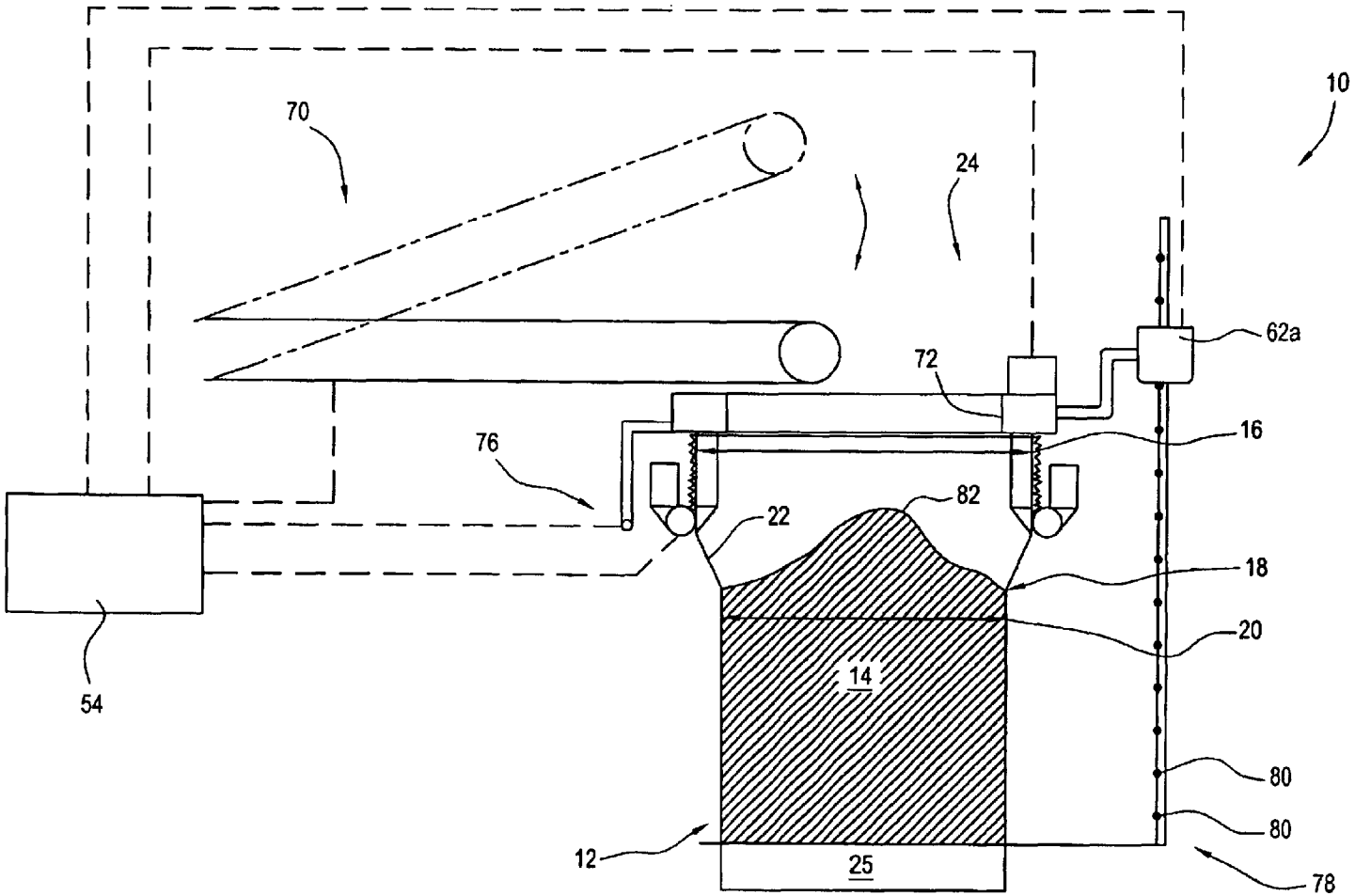
FIG. 1 is a schematic side view of flexible container being filled according to the present invention.

Referring now to FIG. 1, the present invention provides method and apparatus 10 for filling a container 12 with a plurality of particles 14 comprising the steps of filling the radially flexible container 12 through a large diameter 16 with the plurality of particles 14 to a fill level 18 and reducing the large diameter 16 of the radially flexible container 12 to a smaller fill diameter 20 substantially at the fill level 18 as the fill level 18 rises during filling of the flexible container 12. The large diameter 16 is reduced by radially stretching the container 12 prior to filling and, after filling substantially to the fill level 18, releasing a stretched portion or length 22 of the container 12 substantially adjacent the fill level 18. In other words, the container 12 can be expanded to define the large diameter 16 for receiving particles 14. The apparatus can include a stretching device 24 to radially stretch the container 12 prior to filling. The container 12 can be a flexible, resilient bag.

The reduction of the large diameter 16 at the fill level 18 by releasing a stretched portion 22 of the container 12 at the fill level 18 generates hoop forces which apply a gentle squeeze to the fill material 14, helping to support and firm it. The hoop forces stabilize the fill material 14 by promoting controllable contact between the elements of the fill material 14 being loaded into container 12, thereby promoting bridging between the components of the fill material 14. For example, when the fill material 14 being loaded is a bulk cereal in puff or flake form, hoop forces promote bridging between cereal pieces, thereby reducing the relative motion between the pieces and immobilizing the cereal within container 12. By adjusting the extent of shrinkage, hoop forces can be tailored to the type of fill material 14 being inserted in container 12. Hoop forces allow for a very compact and rigid container, which does not allow the fill material 14 to shift or get crushed within container 12. The container 12 is filled without any internal frame or support means, since the subsequent removal of such a frame or support means would result in the hoop forces being dissipated and also cause dislodging of the fill material 14 which may result in some of the fill material 14 being crushed.

Figure 2:
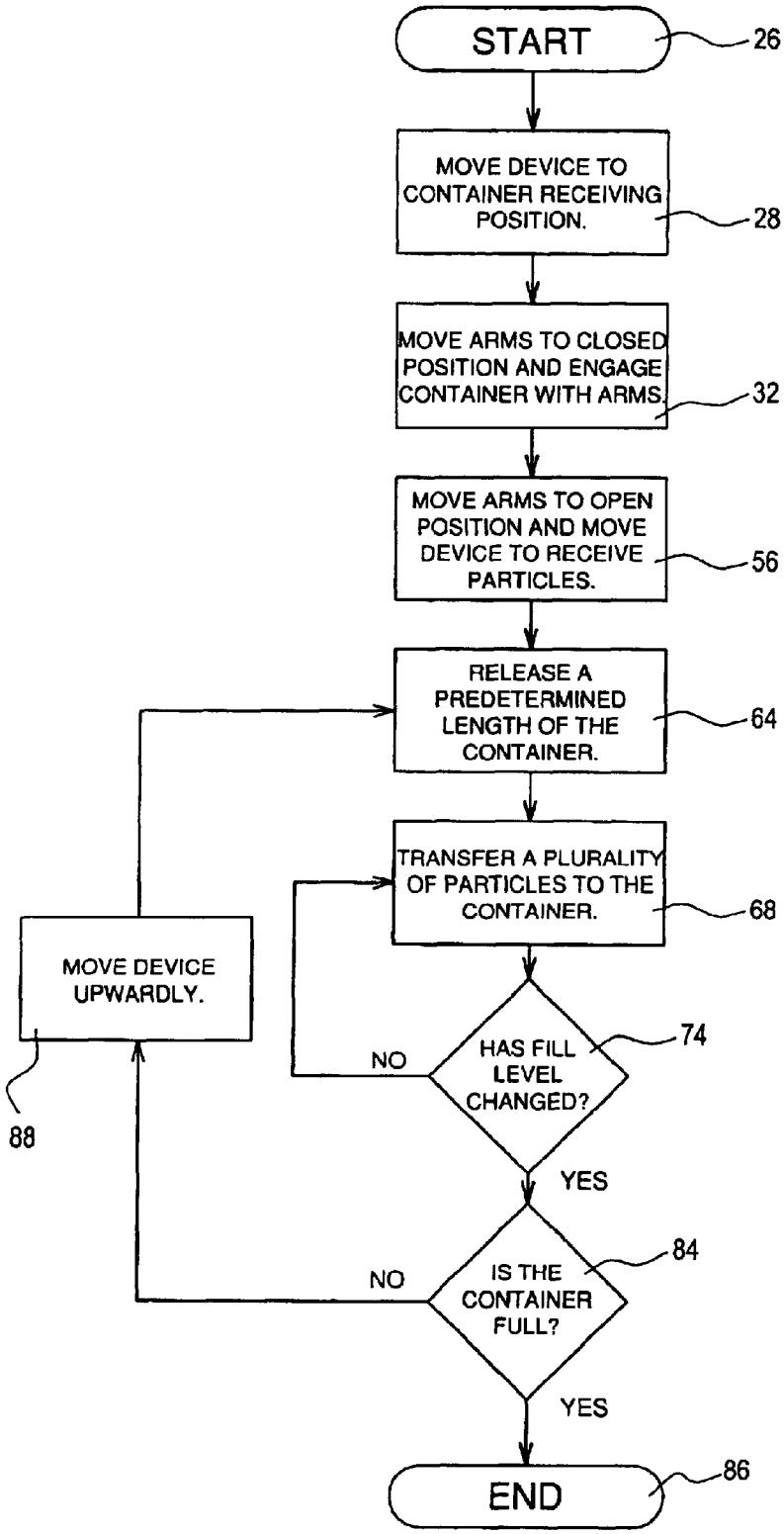
FIG. 2 is a simplified flow diagram illustrating the steps performed by an embodiment of the present invention.
Figure 3:
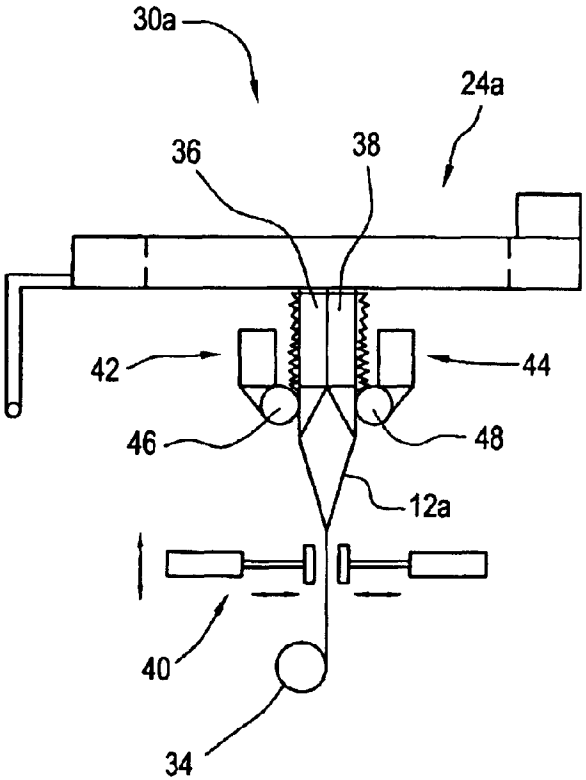
FIG. 3 is a schematic side view of a flexible container being received with respect to a plurality of arms.
Figure 4:
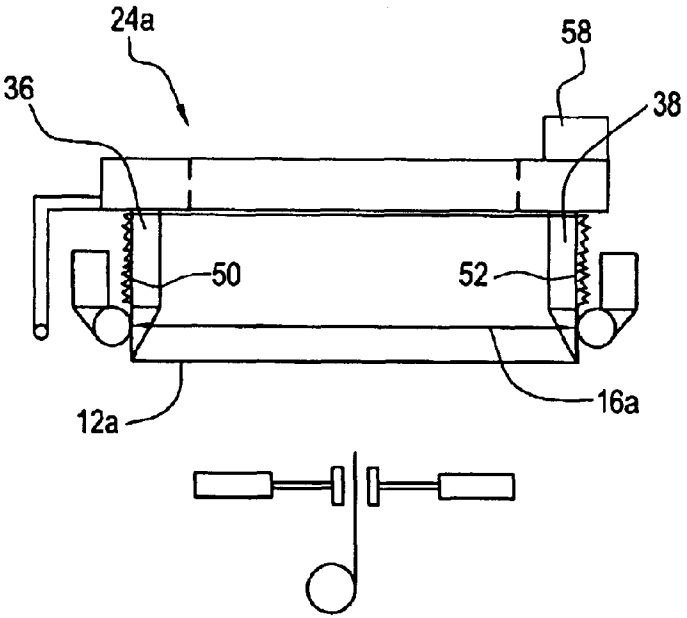
FIG. 4 is a schematic side view of the flexible container shown in FIG. 20 stretched by movement of the plurality of arms.
Figure 5:
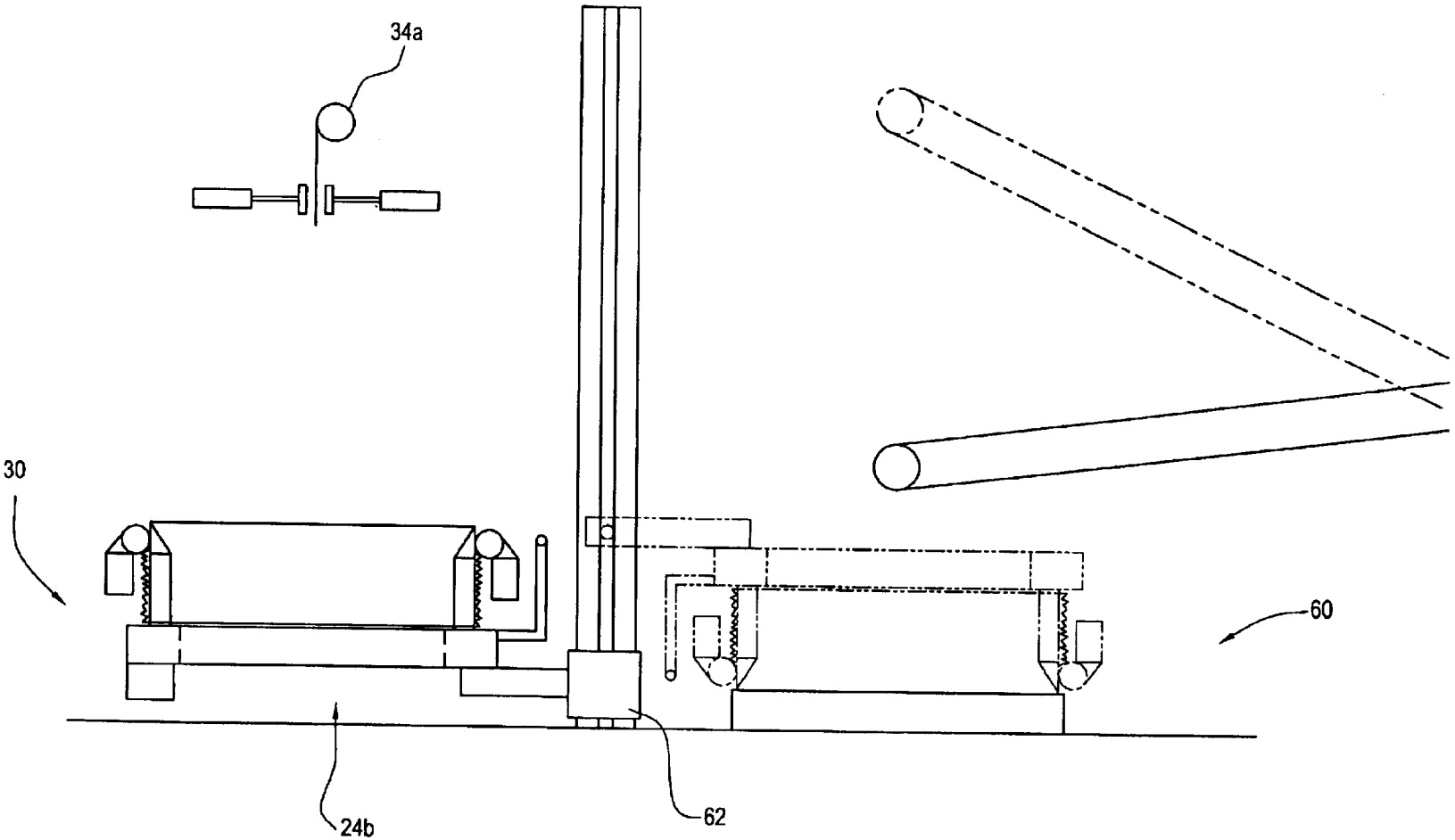
FIG. 5 is a schematic side view of an alternative embodiment of the present invention wherein a support for the flexible container is moveable between a receiving station and a filling station.

A process performable by an embodiment of the present invention is illustrated in the simplified flow diagram of FIG. 2 and the schematic side views of FIGS. 1 and 3–5. The process begins at step 26. At step 28, the device 24*b* as shown in FIG. 5 can be positioned at a container receiving station 30. At step 32, a container 12*a* as shown in FIG. 3 can be engaged with respect to a support 24*a*. The container 12*a* can be in a collapsed configuration and drawn from a roll 34 at a receiving station 30*a*. As shown in FIGS. 3 and 5, a roll 34, 34*a* can be disposed above or below the device 24*a*, 24*b*.

Referring now especially to FIG. 3, the device 24*a* can include a plurality of arms 36, 38 for receiving the container 12*a*. The container 12*a* can be drawn from the roll 34 and opened with an opening device 40. The plurality of arms 36, 38 can be moveable with respect to one another between at least two positions. FIG. 3 shows the arms 36, 38 in a first or closed position. The container 12*a* can be received by the device 24*a* when the arms 36, 38 are in the closed position in step 32. The closed position can be defined by the arms 36, 38 in contact with one another, or by the arms 36, 38 spaced from one another. The arms 36, 38 can be spaced relative to one another in the closed position to enhance engagement of the container 12*a* with the arms 36, 38. For example, the arms 36, 38 can be spaced relative to one another to allow for relatively easy, but positive engagement between the arms 36, 38 and the container 12*a*.

Referring now to FIGS. 3 and 4, the device 24*a* can include one or more roller mechanisms to 42, 44 individually positioned with respect to a corresponding arm 36, 38 to enhance engagement of the container 12 with the respective arm 36, 38. Each roller mechanism 42, 44 can include a wheel or roller 46, 48, respectively, positioned adjacent surfaces 50, 52 of the arms 36, 38. During engagement of the container 12*a* with the surfaces 50, 52, rollers 46, 48 can rotate away from the roll 34 and move the container 12*a* into a bunched orientation. For example, roller 46 can rotate counter-clockwise in FIG. 3 and roller 48 can rotate clockwise to engage the container 12*a* with respect to the device 24*a*. A controller 54 (shown in FIG. 1) can control movement of the rollers 46, 48 in accordance with a control program stored in memory.

Referring now to FIGS. 2 and 4, the process continues to step 56 and the arms 36, 38 are moved to a second or open position. The arms 36, 38 can be moved relative to one another with a motor 58. Movement of the arms 36, 38 to the open position stretches the container 12*a* to the large diameter 16*a*.

Also at step 56, the device 24*a* is moved to receive particles (such as particles 14 shown in FIG. 1). Referring now to FIG. 5, the device 24*b* can be moved between the container receiving station 30 to a particle receiving station 60 with a motor 62. The motor 62 can be operable to rotate or flip the device 24*b* such that the device 24*b* is in an upwardly facing orientation (shown in solid lines) at the container receiving station 30 and in a downwardly facing orientation (shown in phantom lines) at the particle receiving station 60. In addition, the motor 62 can vertically move the device 24*b*. A controller (substantially similar to controller 54 shown in FIG. 1) can control the motor 62 in accordance with a control program stored in memory.

Referring now to FIGS. 1 and 2, the process continues to step 64 and the predetermined length 22 of the container 12 is released with respect to the device 24. Alternatively, at the beginning of the filling process, none of the container 12 can be released and filling can begin with the container 12 in the orientation shown in FIG. 4.

Referring now to FIGS. 1 and 2, the process continues to step 68 and a plurality of particles 14 can be transferred to the container 12. The particles 14 can be transferred to the container 12 with a filling system including a conveyor 70. The particles 14 move along the conveyor 70 and can drop through a passage 72 defined by the device 24. The conveyor 70 can be an articulating conveyor, rotatable about an axis of rotation. The controller 54 can control the conveyor 70 including the rate particles 14 are moved to the passage 72 and the articulation of the conveyor 70.

Step 74 monitors whether the fill level 18 has changed. The fill level 18 can be sensed by a sensor 76. The sensor 76 can be an infrared sensor. The invention can include an infrared sensor emitter array 78 supporting a plurality of infrared emitters 80 along on a path extending parallel to the vertical axis of the container 12. Each emitter 80 can emit infrared radiation substantially traverse with respect to the vertical axis of the container 12. The sensor 76 can be horizontally aligned with at least one of the plurality of infrared emitters 80 during filling of the container 12. When the fill level changes, infrared radiation communicated between the emitter 80 and the sensor 76 can be blocked by the particles 14. In response to a change in the fill level, the sensor 76 can emit a signal to the controller 54. The controller 54 can control a motor 62*a* to vertically move the sensor 76 so that the sensor 76 can receive infrared radiation from one of the plurality of emitters 80. The sensor 76 can be immovably associated with respect to the device 24 such that the motor 62*a* moves the sensor 76 and the device 24 concurrently.

In alternative embodiments of the invention, the sensor 76 can include an ultrasonic transmitter and receiver, applying sound waves to monitor the fill level 18 of the material 14 in the container 12. In another embodiment, a lower support member, such as support member 25 shown in FIG. 1, for supporting the flexible container 12 includes a scale and the release of the stretched portion 22 of the flexible container 12 is coordinated with the measured weight of the fill material 14 thus allowing the portion 22 to be maintained substantially at the fill level 18. In other embodiments, the system includes a timing mechanism that coordinates the incremental release of the stretched portion 22 based on the known fill rate of container 12.

For certain types of fill material 14 it can be advantageous to settle the fill material 14 as the flexible container 12 is being filled. To accomplish this, the support member 25 can include a vibratory shaker thereby permitting the support member 25 to settle the fill material 14 as the container 12 is being filled.

In alternative embodiments of the invention, the support member 25 and the device 24 are vertically movable. In such embodiments, during the initial stages of filling the container 12, the support member 25 is placed at a position very close to the device 24. As the container 12 fills, the support member 25 is moved away from the device 24, in a downward direction, to accommodate the accumulation of fill material 14 in the container 12. The advantage of this system is that fragile materials have a shorter distance to drop from the conveyor 70 into the container 12. Movement of the support member 25 can be accomplished by any of a variety of mechanisms including scissors platform legs, hydraulic pistons, pneumatic pistons, or a geared mechanism.

As used herein, the fill level is the highest level at which particles substantially occupy an entire cross sectional area of the container 12. The plurality of particles can define a crest 82 and the fill level 18 can be below the crest 82. Communication between the sensor 76 and a corresponding emitter 80 can be blocked by the crest 82. The sensor 76 can be spaced from the rollers 46, 48 a distance substantially similar to the distance between the crest 82 and the fill level 18. Alternatively, the sensor 76 and rollers 46, 48 can be substantially aligned with the crest 82. Preferably, the release of the container 12 is kept within plus or minus twelve inches of the crest 82.

Referring now to FIG. 2, if the fill level has not changed in step 74, the process returns to step 68 and a plurality of particles 14 are transferred to the container 12. If the fill level has changed, the process continues to step 84 and the extent of filling of the container 12 is monitored. If the container 12 is fill at step 84, the process ends at step 86. If the container 12 is not full at step 84, the process continues to step 88 and the device 24 is moved upwardly. The device 24 can be moved with the motor 62*a*. The motor 62*a* can be controlled by the controller 54.

After upwardly moving the device 24, the process returns to step 64 and a predetermined length 22 of the container 12 is released with respect to the device 24. During the filling process, the predetermined length 22 can be selected based on the filling rate. For example, a greater length of the container 12 can be released in response to a high fill rate. Alternatively, the length can be selected based on the density of the material. For example, a greater length of the container 12 can be released in response to a higher density fill material. The flexible container 12 can be incrementally released from the bunched orientation or continuously released.

After the length 22 is released, the large diameter 16 of the container 12 will shrink to the fill diameter 20 at the fill level 18. Shrinkage of the container 12 can generate hoop forces to stabilize the plurality of particles 14 and promote controllable contact between the individual particles. In a preferred embodiment, the hoop forces generated are approximately 1–3 lbs. per square inch. Shrinkage of the container 12 can be relatively gentle to bring individual particles into engagement with respect to one another. At any particular cross-section, the engaged particles can form a lattice reducing the likelihood of movement the particles relative to one another and enhancing the structural rigidity of the container 12. Engagement between particles 14 resulting from the application of hoop force at the fill level 18 as the fill level 18 rises can also reduce the likelihood that a blow or acceleration will damage the particles 14.

Referring now to FIG. 1, in operation the controller 54 can control the conveyor 70 to fill the container 12 with particles 14. In particular, the controller 54 can move the articulating conveyor 70 to a downward position and control the conveyor 70 to move particles 14 through the passage 72. The device 24 and the sensor 76 can be immovably associated with respect to one another and be positioned below the articulating conveyor 70. The container 12 can be supported in a bunched orientation by the device 24. The articulating conveyor 70 can move a plurality of particles 14 to be received in the container 12. The sensor 76 can receive infrared radiation from one of a plurality of emitters 80 disposed along the array 78. When the fill level 18 rises such that the sensor 76 is blocked from receiving infrared radiation from a corresponding emitter 80, the sensor 76 can emit a signal corresponding to a change in the fill level 18 to the controller 54. In response, the controller 54 can control the motor 62*a* to move the device 24 vertically upward. The controller 54 can also control the articulating conveyor 70 to move upwardly to prevent the device 24 from contacting the articulating conveyor 70. The controller can also control the rollers 46, 48 to rotate and move the container 12 away from the conveyor 70, releasing the portion 22 from the bunched orientation.

The top of the container 12 can be closed or left open after filling depending on the fill material 14. For example, certain fill material 14 such as wood chips, sand, gravel, and other fill material 14, may not require that the open top be closed. The open top can be closed in any of a variety of manners known in the art including, but not limited to: sonic or heat welding of open top, closure of open top with a plastic pull tie, closure of open top with wire or rope, closure of open top with a clamp, and other closure means known in the art. In embodiments where continuous tubular rolls and sonic or heat welding of the open top are used, the process of sealing the top of one container 12 can also create the bottom of the next container 12.

It may be advantageous that once the container 12 has been filled with fill material 14 to include the additional step of placing a nylon strap netting over the container 12. The netting may include a series of loops either at the top or the bottom of the netting to enable the resulting load to handle like a Super Sack®. Moving the unit with the loops rather than the pallet or bottom support would be advantageous in loading cargo ships with a very stable load with the least amount of cost associated with packaging material.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A method for filling a container with a plurality of particles comprising the steps of filling a radially flexible container through a large diameter with the plurality of particles to a fill level, reducing the large diameter of the radially flexible container to a smaller fill diameter substantially at the fill level as the fill level rises during filling of the flexible container, wherein the reducing step is characterized by:

radially stretching the container prior to reducing.

2. The method of claim 1 wherein said stretching step is further defined as expanding the container to define the large diameter for receiving particles.

3. The method of claim 2 including releasing a stretched portion of the container substantially adjacent the fill level as the fill level rises during filling.

4. The method of claim 3 including maintaining the container in a stretched configuration above the fill level as the fill level rises during filling.

5. The method of claim 4 including sensing the fill level as the fill level rises during filling.

6. The method of claim 5 wherein said releasing step is further defined as releasing the stretched portion of the container adjacent the fill level in response to the sensed fill level.

7. The method of claim 5 including releasibly supporting the container in a bunched orientation during filling of the container.

8. An apparatus for filling a container with a plurality of particles wherein a filling system fills a radially flexible container through a large diameter with the plurality of particles to a fill level, and a diameter reducing system reduces the large diameter of the radially flexible container to a smaller fill diameter substantially at the fill level as the fill level rises during filling of the flexible container, wherein the diameter reducing system is characterized by:

a stretching device to radially stretch the container prior to filling.

9. The apparatus of claim 8 wherein the stretching device includes a plurality of arms for expanding the container to define the large diameter for receiving particles.

10. The apparatus of claim 9 wherein the plurality of arms are moveable with respect to one another between first and second positions, the first position corresponding to a substantially unstretched configuration of the container and the second position corresponding to a stretched configuration of the container.

11. The apparatus of claim 9 wherein each of the plurality of arms includes a surface for supporting the container in a bunched orientation during filling.

12. The apparatus of claim 9 including a roller mechanism positionable with respect to the plurality of arms for releasing a stretched portion of the container with respect to the plurality of arms substantially adjacent the fill level as the fill level rises during filling.

13. The apparatus of claim 12 including a motor to vertically move the plurality of arms during filling of the container.

14. The apparatus of claim 13 including a sensor for sensing the fill level as the fill level rises during filling of the container and emitting a signal corresponding to the fill level.

15. The apparatus of claim 14 including a controller for receiving the signal from the sensor, controlling the roller mechanism to release the portion of the container in response to the signal, and controlling the motor to move the plurality of arms upwardly in response to the signal.

16. The apparatus of claim 8 wherein said particulate material is one of cereal, ready-to-eat cereal, agricultural products, seeds, rice, grains, vegetables, fruits, chemicals, pharmaceuticals, fertilizers, plastic resin pellets, plastic parts, wood chips, landscaping material, peat moss, dirt, sand, gravel, rocks, cement, prepared foods, partially processed foods, frozen fish, frozen chicken, textiles, clothing, footwear, and toys.

17. The apparatus of claim 8 including means to close a top of the container, wherein closing means is selected from the group consisting of a sonic welder, a heat welder, a plastic pull tie, a wire, a rope, and a clamp.

* * * * *